US005631521A

United States Patent [19]

Hasegawa et al.

[11] Patent Number: 5,631,521

[45] Date of Patent: May 20, 1997

[54] ELECTRON GUN FOR COLOR CATHODE RAY TUBE

[75] Inventors: Takahiro Hasegawa, Gyoda; Kazunori Satou, Fukaya; Shigeo Fukuda, Gunma-ken, all of Japan

[73] Assignee: Kabushiki Kaisha Toshiba, Japan

[21] Appl. No.: 358,617

[22] Filed: Dec. 14, 1994

[30] Foreign Application Priority Data

Dec. 14, 1993 [JP] Japan ..... 5-312364

[51] Int. Cl.[6] ..... H01J 29/51; H01J 29/50

[52] U.S. Cl. ..... 313/414; 313/412; 313/449

[58] Field of Search ..... 313/412, 413, 313/414, 449; 315/382, 14, 15

[56] References Cited

U.S. PATENT DOCUMENTS

| | | | |
|---|---|---|---|
| 4,935,663 | 6/1990 | Shimoma et al. . | |
| 4,945,284 | 7/1990 | Shimona et al. | 313/414 |
| 5,347,202 | 9/1994 | Stil | 313/414 |

FOREIGN PATENT DOCUMENTS

| | | |
|---|---|---|
| 0334197 | 9/1989 | European Pat. Off. . |
| 2832687 | 2/1980 | Germany . |
| 1-42109 | 9/1989 | Japan . |
| 2-223136 | 9/1990 | Japan . |
| 2034516 | 6/1980 | United Kingdom . |
| 2099214 | 12/1982 | United Kingdom . |

*Primary Examiner*—Nimeshkumar Patel

*Attorney, Agent, or Firm*—Cushman Darby & Cushman Intellectual Property Group of Pillsbury Madison & Sutro, LLP

[57] ABSTRACT

In a color cathode ray tube apparatus having an electron gun assembly for emitting three electron beams disposed in one line, the electron gun assembly has at least first, second, and third electrodes G5, G7, and G9 applied with a voltage which changes in synchronization with deflection of electron beams. The first electrode and an electrode G4 adjacent thereto form first eccentric lenses for deflecting a pair of side beams in a direction in which the side beams extend to be close to the center beam. The second electrode and an electrode G6 adjacent thereto form second eccentric lenses for deflecting the side beams in a direction in which the side beams extend to be apart from the center beam. The third electrode and an electrode G8 adjacent thereto form third eccentric lenses for deflecting the side beams in a direction in which the side beams extend to be close to the center beam. An electron lens common to the three electron beams is formed between the second and third eccentric lenses. It is possible to realize a color cathode ray tube apparatus which displays a high quality image over the entire area of the screen by means of these electron lenses.

3 Claims, 3 Drawing Sheets

ELECTRON GUN FOR COLOR CATHODE RAY TUBE

BACKGROUND OF THE INVENTION

1. Field of the Invention

The present invention relates to a color cathode ray tube apparatus having an electron gun assembly of in-line type which emits three electron beams disposed in one line on one plane, and particularly, to a color cathode ray tube apparatus having an electron gun assembly of dynamic focus method by which good convergence is obtained over the entire area of a screen.

2. Description of the Related Art

In general, a color cathode ray tube apparatus is constructed to have a structure in which a fluorescent screen consisting of three color fluorescent material layers which respectively radiate in blue, green, and red colors, and the three electron beams emitted from an electron gun assembly is deflected by a deflection magnetic field generated by a deflecting apparatus, so that the above fluorescent screen is scanned in the horizontal and vertical directions, thereby displaying a color image. In this kind of color cathode ray tube apparatus, the color cathode ray tube apparatus typically uses three electron beams emitted from the electron gun assembly which consist of a center beam passing through a horizontal plane and a pair of side beams, which are disposed in one line on one plane.

Also, in general, the color cathode ray tube apparatus of this in-line type uses an electron gun assembly which has three cathodes disposed in one line in a horizontal direction, electron beam generating portions respectively disposed adjacent to the cathodes in the direction toward the fluorescent screen, and a plurality of electrodes having an integral structure and forming a main lens portion. The main lens portion has a function of static convergence, and due to this function of the main lens portion, each of three electron beams is focused so as to form a small beam spot on the fluorescent screen. Simultaneously, the pair of side beams are so shifted as to be close to the center beam, and are converged onto one point of the fluorescent screen.

Therefore, in an electron gun assembly of the color cathode ray tube apparatus having this kind of main lens portion, there is a problem that static convergence undesirably changes as a focusing voltage is adjusted.

As a technique for adjusting the focus voltage and solving the problem of changes in static convergence, Jpn. Pat. Appln. KOKAI Publication No. 1-42109 discloses means for performing a first orbit correction for deflecting a pair of side beams in a direction in which the beams extend to be close to a center beam near electron beam passing holes formed in the cathode side of focusing electrodes, and for performing a second orbit correction for deflecting the pair of side beams in the direction in which the beams extend to be close to the center beam, thereby complementarily influencing the first orbit correction in the cathode side of focusing electrodes and the second orbit correction in the main lens portion, by means of two-stage orbit corrections made to the pair of side beams when the focusing voltage is adjusted.

Meanwhile, a color cathode ray tube apparatus which has a large screen and displays a highly definite image of high quality is greatly required. As an electron gun assembly of this kind of color cathode ray tube apparatus, various new electron gun assemblies have been developed. One of the assemblies is, for example, an electron gun assembly of a resistor division method disclosed in Jpn. Pat. Appln. KOKAI Publication 2-223136. This electron gun assembly is constructed so as to have a structure in which an anode voltage is divided by a resistor provided in a tube and supplied to an electrode forming a main lens. Therefore, a highly definite image of high quality can be displayed and a high reliability is ensured against a tube discharge.

Further, in this electron gun assembly of resistor division method, developments have been made to an electron gun assembly of dynamic focus method which changes a focusing voltage in synchronization with a deflection of an electron beam. In case of this electron gun assembly of the dynamic focus method, when a peripheral portions of a fluorescent screen is scanned with an electron beam, the focusing voltage is higher by about 1000 V than when a central portion of the screen is scanned. When the focus voltage is thus high, convergence at a peripheral portion of the fluorescent screen is offset by about 1.0 mm.

If the technical means disclosed in the above-mentioned Jpn. Pat. Appln. KOKAI Publication No. 1-42109 is adopted to reduce convergence in a peripheral portion of the fluorescent screen, an offset in convergence is not substantially reduced.

In general, since a tolerance of convergence offset in the peripheral portion of a fluorescent screen is 0.3 mm or less, a convergence offset of the electron gun assembly of the above dynamic focus method exceeds the tolerance and greatly reduces image quality.

As has been stated above, the main lens portion of the electron gun assembly of a color cathode ray tube apparatus has a focusing function of focusing three electron beams emitted from an electron gun assembly and a static convergence function of focusing the three electron beams. The three electron beams are focused so as to form a small beam spot on a fluorescent screen, and simultaneously, a pair of side beams are deflected in a direction extending to be close to a center beam. Therefore, the electron gun assembly of the color cathode ray tube apparatus has a problem in that static convergence changes when the focus voltage is adjusted.

In particular, in an electron gun assembly of resistor division method which has been recently developed as an electron gun assembly of a color cathode ray tube apparatus which displays a highly definite image of high quality, a convergence offset in a peripheral portion of a fluorescent screen exceeds a tolerance and thereby greatly reduces image quality.

SUMMARY OF THE INVENTION

The present invention has an object of providing a color cathode ray tube apparatus comprising an electron gun assembly of dynamic focusing method for changing a focusing voltage in synchronization with deflection of electron beams, in which a convergence offset in a peripheral portion of a fluorescent screen is reduced and a high quality image is displayed over the entire area of the screen.

A color cathode ray tube apparatus is constructed such that three electron beams, i.e., a center beam and a pair of three electron beams which are emitted from an electron gun assembly having cathodes and a plurality of electrodes disposed in order in a direction from the cathodes toward a fluorescent screen are deflected by a deflection device thereby to scan the fluorescent screen. Among these electrodes, the first electrode and the electrode adjacent thereto are used to form first eccentric lenses for deflecting the pair of side beams in a direction extending to be close to the center beam, the second electrode and the electrode adjacent thereto are used to form second eccentric lenses for deflecting the pair of side beams in a direction extending to be apart from the center beam, and the third electrode and the electrode adjacent thereto are used to form third eccentric lenses for deflecting the pair of side beams in a direction extending to be close to the center beam. An electron lenses common to the three electron beams is formed between the second and third eccentric lenses.

In an electron gun assembly having the structure stated above, the first electrode and the electrode adjacent thereto form the first eccentric lenses, the second electrode and the electrode adjacent thereto form the second eccentric lenses, and the third electrode and the electrode adjacent thereto form the third eccentric lenses. When the electron beams are not deflected, the pair of side beams are deflected in a direction in which the side beams extend to be close to the center beam by the first eccentric lenses, then deflected in a direction in which the side beams extend to be apart from the center beam by the second eccentric lenses, further deflected in a direction in which the side beams extend to be close to the center beam by the electron lens common to the three electron beams, formed between the second and third eccentric lenses, and then deflected in a direction in which the side beams extend to be close to the center beam by the third eccentric lenses. The center beam and the pair of side beams can thus be concentrated onto a point in the center of the fluorescent screen.

Otherwise, when electron beams are deflected to a peripheral portion of the screen, it is possible to strengthen the first eccentric lenses, weaken the second eccentric lenses, weaken the electron lens common to three electron beams, and simultaneously keep the third eccentric lenses unchanged, by increasing the focusing voltage. By means of these first, second, and third eccentric lenses and the electron lens common to the three electron beams, and particularly, a pair of side beams are deflected by the first eccentric lenses in a direction extending to be close to the center beam and then deflected by the second eccentric lenses in a direction extending to be apart from the center beam. However, since the second eccentric lenses less intensively deflect the pair of side beams than in the case where electron beams are not deflected, the pair of side beams still keep extending in a direction to be close to the center beam after they pass the second deflection lenses. Further, since the electron lens common to three electron beams is weakened, the orbits of the pair of side beams cannot be substantially changed by this lens common to the three electron beams. Then, the pair of side beams are deflected by the third eccentric lenses in a direction extending to be close to the center beam. The center beam and the pair of side beams can thus be concentrated onto a point on a peripheral portion of the fluorescent screen.

Specifically, when electron beams are deflected to a peripheral portion of the screen, the functions of the first and second eccentric lenses and the function of the electron lens common to three electron beams are compensated for each other. It is therefore possible to concentrate a center beam and a pair of side beams onto a point on a peripheral portion of the fluorescent screen, as in the above case when electron beams are not deflected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

In the following, the color cathode ray tube apparatus of the present invention will be explained on the basis of an embodiment, with reference to the drawings.

Figure 1:
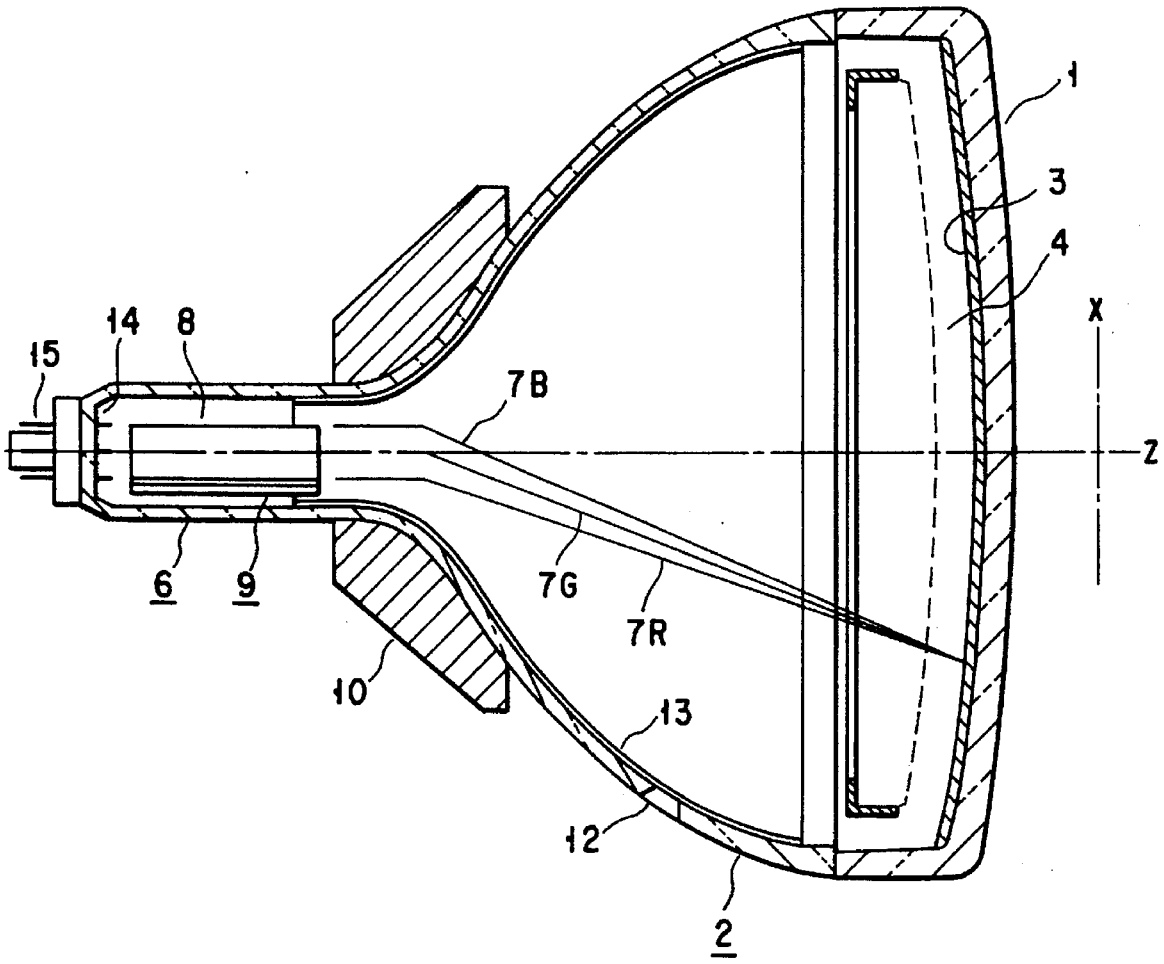
FIG. 1 shows the structure of a color cathode ray tube apparatus of an embodiment according to the present invention.

FIG. 1 shows a color cathode ray tube apparatus according to an embodiment of the present invention. This color cathode ray tube apparatus has an envelope consisting of a panel 1 and a funnel 2 integrally coupled with the panel, and a fluorescent screen 3 consisting of three-color fluorescent layers which respectively radiate in blue, green, and red colors is formed on an inner surface of the panel. A shadow mask 4 is provided so as to face the fluorescent screen 3, and a number of electron beam through holes are formed in the inner side. Meanwhile, an electron gun assembly 8 for emitting three electron beams 7B, 7G, and 7R disposed in one line is provided in a neck 6 of the funnel 2, and the the three electron beams 7B, 7G, and 7R are a center beam 7G and a pair of side beams 7B and 7R which pass through a horizontal plane (or an x-z plane). Further, a resistor 9 which will be described later is provided along the electron gun assembly 8 on the side thereof. Three electron beams 7B, 7G, and 7R emitted from the electron gun assembly 8 are deflected by a magnetic field generated by a deflection yoke 10, thereby to scan the fluorescent screen 3 in the horizontal and vertical directions and to display a color image.

In FIG. 1, reference numeral 12 denotes an anode terminal provided on a side wall of a large diameter portion of a funnel 2, and reference numeral 13 denotes an inner surface conductive film applied and formed on an inner surface of an adjacent contact portion from the large diameter portion of the funnel 2 to the neck 6. Reference numeral 14 denotes a stem enclosing an end portion of the neck 6, and reference numeral 15 denotes a stem pin which air-tightly passes through the stem 14.

Figure 2:
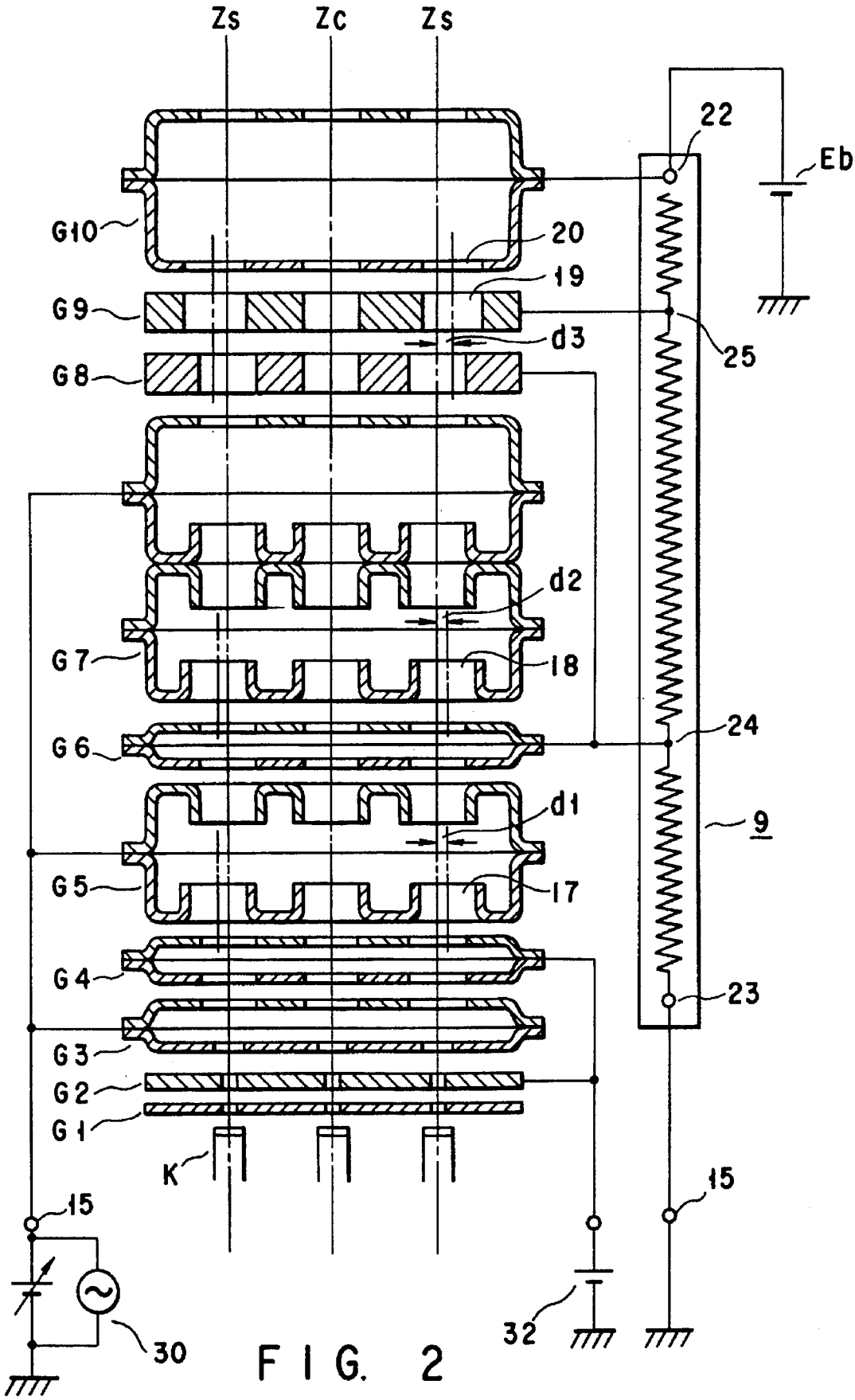
FIG. 2 shows the structure of an electron gun assembly of a color cathode ray tube apparatus according to the present invention.

As shown in FIG. 2, the electron gun assembly 8 has three cathodes K disposed in a horizontal direction, three heaters (not shown) for respectively heating the cathodes K, and first to tenth grids G1 to G10 disposed at predetermined intervals in a direction toward the fluorescent screen from the cathodes K. The assembly 8 is constructed such that the cathodes K, heaters, and first to tenth grids G1 to G10 are integrally fixed by a pair of insulating support members (not shown).

As shown in FIG. 2, first and second grids G1 and G2 are respectively formed of plate electrodes having relatively small thickness. Third and fourth grids G3 and G4, as well as fifth and sixth grids, are formed of a cylindrical electrode consisting of two cup-like electrodes coupled with each other. (The fifth grid G5 forms a first electrode.) A seventh grid G7 (or a second electrode) is formed of four cup-like electrodes coupled into two pairs of cylindrical electrodes. Eighth and ninth grids G8 and G9 are respectively formed of plate-like electrodes which are relatively thick. (The ninth grid G9 forms a third electrode.) A tenth grid G10 is formed of a cylindrical electrode consisting of two cup-like electrodes coupled with each other.

Three circular electron beam through holes for allowing electron beams to pass are formed so as to correspond to three cathodes K in each of these grids G1 to G10 such that the holes are disposed in one line in the horizontal direction. The electron beam through holes of the first and second grids G1 and G2 are formed to be relatively small. The electron beam through holes formed in the side of the third grid G3 facing the second grid G2 are formed to be larger than the electron beam through hole of the second grid G2. Electron beams through holes which have a substantially equal size and are larger than the electron beam through holes of the side of third grid G3 facing the second grid G2 are formed in the side of the third grid G3 facing the fourth grid G1, and in the fourth to tenth grids G4 to G10. Of these electron beam through holes, those of the fifth grid G5 formed of a cylindrical electrode and those of the side of the seventh grid G7 facing the sixth grid G6 and middle portions of the seventh grid G7 are electron beam through holes having side walls. The electron beam through holes formed in the side of the seventh grid G7 facing the eighth grid G8 are electron beam through holes having no side walls.

Of three electron beam holes formed in each of the grids G1 to G10, the center beam through hole is positioned on an axis zc which corresponds to the tube axis z, while the side beam through holes 17 of the side of fifth grid G5 facing the fourth grid G4, the side beam through holes 18 of the side of the seventh grid G7 facing the sixth grid G6, the side beam through holes 19 of the ninth grid G9, and the side beam through holes 20 of the side of the tenth grid G10 facing the ninth grid G9 are deviated to the outside in the direction (i.e., the horizontal direction) in which three electron beam through holes are disposed, with respect to the axis zs passing through the centers of the other side beam through holes.

In this specific example of an electron gun assembly, the distance between the axis zc of the center beam through holes and the axes zs of the side beam through holes is 6.6 mm. An eccentricity amount d1 of the side beam through holes of the side of the fifth grid G5 facing the fourth grid G4 is 0.06 mm and an eccentricity amount d2 of the side beam through holes of the side of the seventh grid G7 facing the sixth grid G6 is also 0.06 mm. The side beam through holes of the ninth grid G9 and the side beam through holes of the side of the tenth grid G10 facing the ninth grid G9 have an eccentricity amount d3 of 0.33 mm which is greater than the eccentricity amount d1 of the side beam through holes of the side of the fifth grid G5 facing the fourth grid G4 and the eccentricity amount d2 of the side beam through holes of the side of the fifth grid G5 facing the sixth grid G6. In addition, each of the electron beam through holes of the side of the third grid G3 facing the fourth grid G4 and of the fourth to tenth grids G4 to G10 are formed to have a diameter of 5.5 mm to 6.2 mm.

A resistor 9 has an end portion 22 connected to the tenth grid G10 of the electron gun assembly 8 and another end portion 23 grounded through a stem pin 15 outside the tube. This resistor 9 divides an anode voltage Eb supplied to the tenth grid G10 into predetermined voltages which are respectively applied to the sixth, eighth, and ninth grids G6, G8, and G9 of the electron gun assembly 8 by means of intermediate terminals 24 and 25.

In the electron gun assembly 8, the tenth grid G10 is applied with an anode voltage Eb through an anode terminal 12, an inner surface conductive film 13, and a valve spacer (not shown) which is attached to the tenth grid G10 and is pressed into contact with the inner surface conductive film 13. A voltage of about 65% of the anode voltage Eb divided by the resistor 9 is applied to the ninth grid G9 from the intermediate terminal 25 of the resistor 9. The eighth grid G8 and the sixth grid G6 are connected with each other in the tube, and a voltage of about 40% of the anode voltage Eb divided by the resistor 9 is applied to the these electrodes from the intermediate terminal 24. The seventh grid G7, the fifth grid G5, and the third grid G3 are connected with each other in the tube, and these electrodes are applied with a voltage of about 28% of the anode voltage Eb through a stem pin 15 which air-tightly penetrates through the stem of the end portion of the neck 6, and a dynamic focus voltage which changes in synchronization with deflection of electron beams, from a variable voltage source 30. The fourth grid G4 and the second grid G2 are connected with each other in the tube, and a voltage of about 800 V is applied to these electrodes through the stem pin 15. Further, the first grid G1 is grounded and the cathodes K are applied with a voltage obtained by layering video signals on a cut-off voltage of about 100 V.

By thus applying voltages, cathodes k and first and second grids G1 and G2 disposed adjacent to the cathodes K form an electron beam generator portion, and third to tenth grids G3 to G10 form a main lens portion which focuses and concentrates three electron beams from the electron beam generator portion onto a fluorescent screen.

Figure 3A:
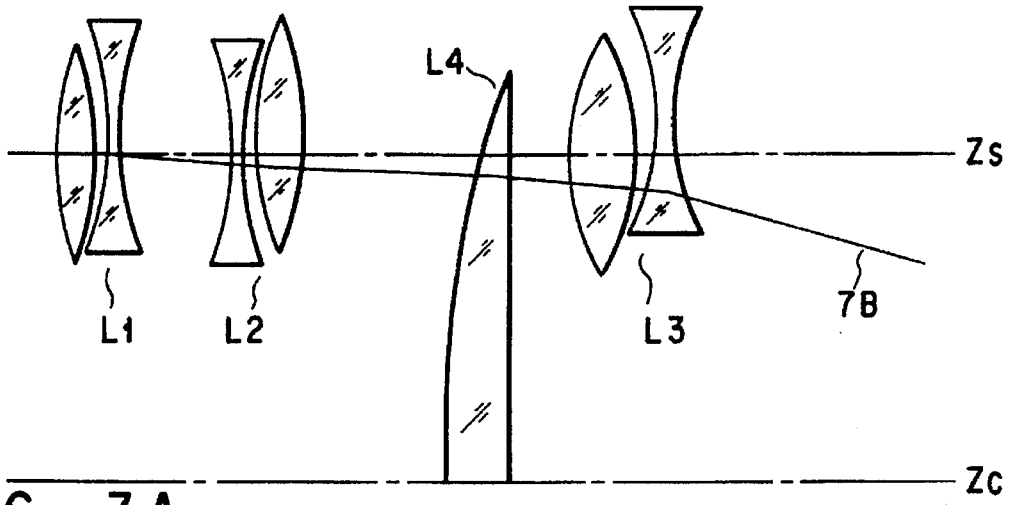
FIGS. 3A and 3B are views showing a main electron lens formed at a main lens portion of the electron gun assembly shown in FIG. 2.
Figure 3B:
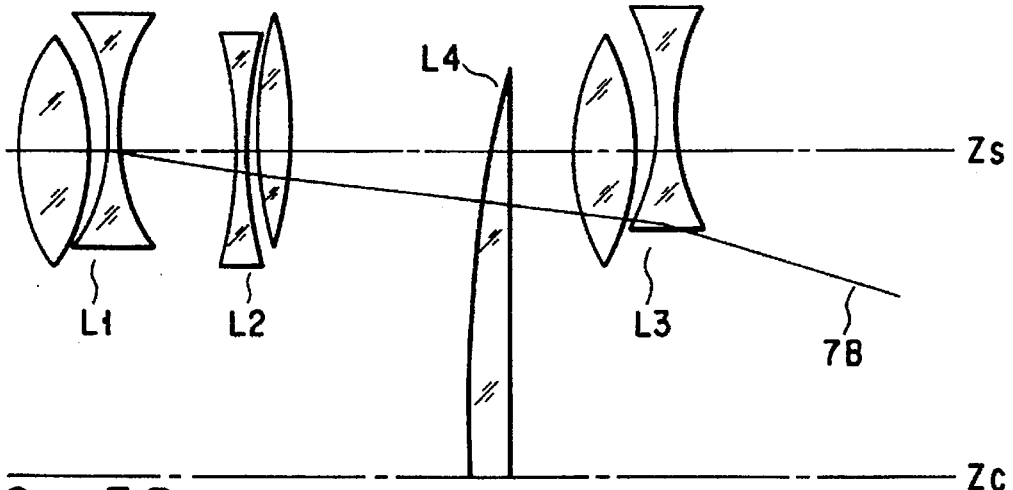

FIGS. 3A and 3B show a main electron lens formed in this main lens portion. FIGS. 3A and 3B show cases where electron beams 7B, 7G, and 7R are deflected to a central region of a screen and where the beams are deflected to a peripheral region of the screen. Only the side beam 7B is shown in these figures. Since electron beam through holes having side walls in the side of the fifth grid G5 facing the fourth grid G4 are formed, three independent electron lenses are provide so as to correspond to a center beam 7G and a pair of side beams 7B and 7R between the fourth and fifth grids G4 and G5. Further, since the side beam through holes of the side of fifth grid G5 facing the fourth grid G4 are deviated to the outside in the direction in which three electron beam through holes are disposed, in relation to the side beam through holes of the side of the fourth grid G4 facing the fifth grid G5, first eccentric lenses L1 are formed for a pair of side beams 7B and 7R.

Likewise, since electron beam through holes having side walls in the side of the seventh grid G7 facing the sixth grid G6 are formed, three independent electron lenses are formed so as to correspond to the center beam 7G and a pair of side beams 7B and 7R, between the sixth and seventh grids G6 and G7. Further, since side beam through holes of the side of the sixth grid G6 facing the seventh grid G7 are deviated to the outside in the direction in which three electron beams are disposed, second eccentric lenses L2 are formed for a pair of side beams 7B and 7R.

Meanwhile, since the eighth and ninth grids G8 and G9 are formed of electrodes which are relatively thick, three independent electron lenses are formed so as to correspond to a center beam 7G and a pair of side beams 7B and 7R between the eighth and ninth grids G8 and G9. Further, since the side beam through holes of the ninth grid G9 are deviated in relation to the side beam through holes of the eighth grid G8 to the outside in the direction in which three electron beam through holes are disposed, third eccentric lenses L3 are formed so as to correspond to the pair of side beams 7B and 7R.

Further, since electron beam through holes having no side walls are formed in the side of the seventh grid G7 facing the eighth grid G8, electron lenses L4 common to the center beam 7G and the pair of side beams 7B and 7R are formed between the seventh and eighth grids G7 and G8.

Figure 4:
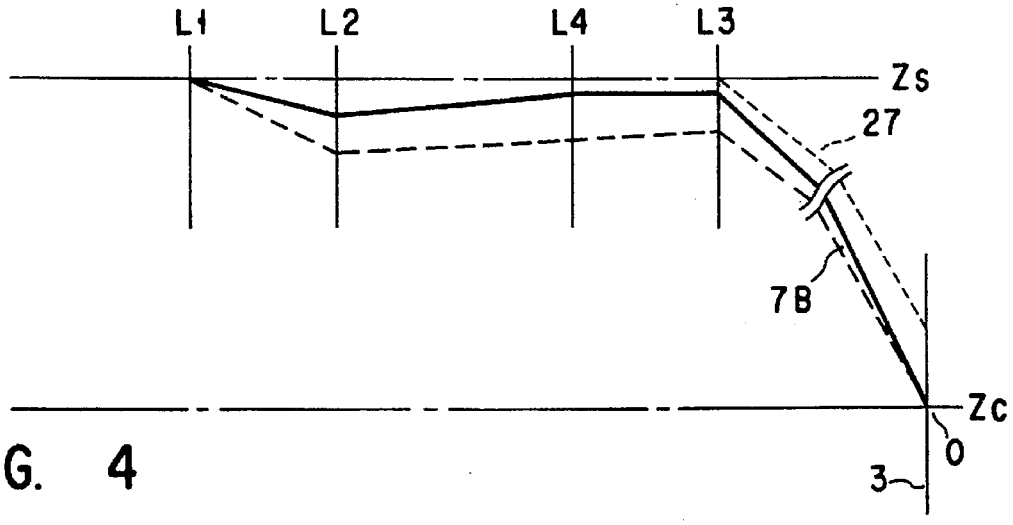
FIG. 4 is a view showing a function of the main electron lens formed at the main lens portion shown in FIG. 3.

Although other electron lenses than the first, second, and third eccentric lenses L1, L2, and L3, and the electron lenses L4 common to the three electron beams are formed in this main lens portion, those lenses are omitted from FIGS. 3A and 3B.

Where electron beams are not deflected as shown in FIG. 3A which illustrates a side beam 7B, when the main lens portion of the electron gun assembly is constructed to form electron lenses L1, L2, L3 and L4, as explained above, a side beam 7B extracted from an electron beam generator portion along the axis zs of a side beam through hole is deflected by the first eccentric lenses L1 in a direction extending to be close to the center beam passing through the axis zc of the center beam through hole, as is indicated by a continuous line in FIG. 4. Thereafter, the side beam 7B is deflected in a direction extending to be apart from the center beam by the second eccentric lens. The side beam 7B is further deflected in a direction extending to be close to the center beam by the electron lens 4 common to the three electron beams. The side beam 7B is then deflected in a direction extending to be close to the center beam by the third eccentric lenses L3, and reaches a center O on the third eccentric lenses. Thus, a center beam and a pair of side beams are concentrated onto one point on a central portion of the fluorescent screen 3.

Meanwhile, when focusing voltages applied to the third, fifth, and seventh grids G3, G5, and G7 are increased in synchronization with deflection of electron beams, the first eccentric lenses L1 are strengthened, the second eccentric lenses L2 are weakened, and the electron lens L4 common to the three electron beams while the third eccentric lenses L3 are not changed. As a result of this, a side beam 7B extracted from an electron beam generator portion along the axis zs of a side beam through hole is more deflected in a direction extending to be close to the center beam by the first eccentric lenses L1 as indicated by a broken line in FIG. 4 than in the case where the electron beam is not deflected. The side beam is then deflected in a direction extending to be apart from the center beam by the second eccentric lens L2, while the side beam keeps extending in the direction to be close to the center beam. The side beam further extends without being substantially deflected by the electron lens L4 common to three electron beams, and is deflected by the third eccentric lens L3 in a direction extending to be close to the center beam. The side beam reaches a peripheral portion of the fluorescent screen 3, and thus, a center beam and a pair of side beams are concentrated onto a point on the peripheral portion of the fluorescent screen 3.

In addition, a dotted line 27 in FIG. 4 indicates an orbit of a side beam where the first and second eccentric lenses L1 and L2 are not formed. FIG. 4 is illustrated such that electron beams reach the same positions on a fluorescent screen 3 as they reach in case where electron beams are deflected, for convenience. Although an electron beam emitted from the electron gun assembly is deflected by a magnetic field generated by a deflection device, thereby drawing a curve, FIG. 4 illustrates the electron beam as a linear line for convenience.

Table 1 shows the distance (or intervals) between a pair of side beams in a peripheral portion of the screen when the focusing voltage is increased by 1,000 V, and compares an electron gun assembly of the above embodiment with another electron gun assembly which has the same structure of the embodiment but does not form at least one of the first and second eccentric lenses L1 and L2, with respect to a 32-inch color image receiving tube. This table 1 also compares the distances under different conditions with each other, i.e., where three electron beams are not deflected, where three electron beams are adjusted so as to concentrate on a center point of the screen, and where three electron beams are deflected to a peripheral portion of the screen.

TABLE 1

| | First Electric Lens | Second Electric Lens | Distance Between Beam Spots of Side Beams (mm) |
|---|---|---|---|
| A | Not used | Not used | 1.0 |
| B | Used | Not used | 0.6 |
| C | Not used | Used | 0.7 |
| Embodiment | Used | Used | 0 |

As shown in this table 1, where at least one of the first and second eccentric lenses L1 and L2 is not formed, an offset of 0.6 mm or more occurs in any case. In the electron gun assembly of this example, offsets of a pair of side beams could be reduced to zero. In addition, reference B of the table 1 relates to the same structure as that of a conventional electron gun assembly disclosed in Jpn. Pat. Appln. KOKOKU Publication No. 1-42109.

An electron gun assembly which emits three electron beams, i.e., a center beam and a pair of side beams disposed in one line is constructed so as to have such a structure which includes at least first, second, and third electrodes applied with a voltage which changes in synchronization with deflection of the electron beams. Among these electrodes, the first electrode and the electrode adjacent thereto are used to form first eccentric lenses for deflecting the pair of side beams in a direction extending to be close to the center beam, the second electrode and the electrode adjacent thereto are used to form second eccentric lenses for deflecting the pair of side beams in a direction extending to be apart from the center beam, and the third electrode and the electrode adjacent thereto are used to form third eccentric lenses for deflecting the pair of side beams in a direction extending to be close to the center beam. An electron lens common to the three electron beams is formed between the second and third eccentric lenses. In this structure, when the electron beams are not deflected, a pair of side beams are deflected in a direction extending to be close to a center beam by the first eccentric lenses, then deflected in a direction extending to be apart from the center beam, further deflected in a direction extending to be close to the center beam by the electron lens common to the three electron beams, formed between the second and third eccentric lenses, and then deflected in a direction extending to be close to the center beam. A center beam and a pair of side beams can thus be concentrated onto a point in the center of a fluorescent screen.

Otherwise, when electron beams are deflected to a peripheral portion of the screen, it is possible to strengthen the first eccentric lenses, weaken the second eccentric lenses, weaken the electron lens common to three electron beams, and simultaneously keep the third eccentric lenses unchanged, by increasing the focusing voltage. By means of these first, second, and third eccentric lenses and the electron lens common to the three electron beams, and particularly, a pair of side beams are deflected by the first eccentric lenses in a direction extending to be close to the center beam and then deflected by the second eccentric lenses in a direction extending to be apart from the center beam. However, since the second eccentric lenses less intensively deflect the pair of side beams than in the case where electron beams are not deflected, the pair of side beams still keep extending in a direction extending to be close to the center beam after they pass the second deflection lenses. Further, since the electron lens common to three electron beams is weakened, the orbits of the pair of side beams cannot be substantially changed by this lens common to the three electron beams. Then, the pair of side beams are deflected by the third eccentric lenses in a direction extending to be close to the center beam. The center beam and the pair of side beams can thus be concentrated onto a point on a peripheral portion of the fluorescent screen.

Specifically, when electron beams are deflected to a peripheral portion of the screen, the functions of the first and second eccentric lenses and the function of the electron lens common to three electron beams are compensated for each other. It is therefore possible to attain a color cathode ray tube in which a center beam and a pair of side beams can be concentrated onto a point on a fluorescent screen as in the case where electron beams are not deflected, excellent convergence can be obtained over the entire area of the fluorescent screen, and a high quality image can be displayed over the entire area of the screen.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus, comprising:

generating means for generating two side beams and a center beam arranged in one line;

emitting means, to which electron beams are landed, for emitting light rays;

deflecting means for deflecting the electron beams, thereby to scan the emitting means;

voltage generating means for generating a voltage which changes in synchronization with deflection of the electron beams; and electron lens means disposed between said beam generating means and said emitting means, (L1, L2, L3, L4) for focusing and converging electron beams from the generating means, including first and second electrodes (G5, G7) operatively coupled to said voltage generating means and applied with a voltage generated by said voltage generating means, which changes in synchronization with deflection of electron beams (7R, 7G, 7B), and a third electrode (G9) operatively coupled to and applied with a voltage via a resistor (9), and electrodes (G4, G6, G8) respectively provided adjacent to the first, second, and third electrodes, said electrodes being disposed in the axial direction of said tube, said first electrode and said electrode (G4) adjacent thereto forming a first eccentric lens (L1) for deflecting the side beams (7B, 7R) in a direction toward the center beam (7G), said second electrode and said electrode (G6) adjacent thereto forming a second eccentric lens (L2) for deflecting the pair of side beams (7R, 7B) in a direction away from the center beam (7G), said first eccentric lens (L1) being formed between said second eccentric lens (L2) and said beam generating means, said third electrode and the electrode (G8) adjacent thereto forming a third eccentric lens (L3) for deflecting the pair of side beams (7R, 7B) in a direction toward the center beam, said third eccentric lens (L3) being formed between said second eccentric lens (L2) and said emitting means, and said electron lens means (L4) being common to the three electron beams (7R, 7G, 7B), and being formed between the second and third eccentric lenses (L2, L3).

2. A color cathode ray tube apparatus according to claim 1, wherein the first, second, and third electrodes and the electrodes respectively provided adjacent thereto have circular holes allowing the side beams and the center beam to pass, and the circular holes of the first, second, and third electrodes are deviated in relation to the centers of the circular holes of the electrodes provided adjacent to said first, second, and third electrodes.

3. A color cathode ray tube apparatus according to claim 1, wherein the electrodes (G4, G6, G8) respectively provided adjacent to the first, second and third electrodes are applied with constant voltages different from each other.

* * * * *